US007305751B2

(12) United States Patent
Lerchenmueller et al.

(10) Patent No.: US 7,305,751 B2
(45) Date of Patent: Dec. 11, 2007

(54) ELECTRICAL CONTACT BETWEEN THIN VARNISHED WIRES OF THE SECONDARY WINDING OF AN IGNITION COIL

(75) Inventors: Klaus Lerchenmueller, Immenstadt (DE); Konstantin Lindenthal, Blaichach (DE); Thomas Breckle, Bihlerdorf (DE); Juergen Raedler, Borgberg (DE)

(73) Assignee: Robert Bosch GmbH, Stuttgart (DE)

( * ) Notice: Subject to any disclaimer, the term of this patent is extended or adjusted under 35 U.S.C. 154(b) by 119 days.

(21) Appl. No.: 10/531,841

(22) PCT Filed: Jul. 25, 2003

(86) PCT No.: PCT/DE03/02513

§ 371 (c)(1),
(2), (4) Date: Apr. 12, 2006

(87) PCT Pub. No.: WO2004/042749

PCT Pub. Date: May 21, 2004

(65) Prior Publication Data

US 2006/0211292 A1 Sep. 21, 2006

(30) Foreign Application Priority Data

Nov. 7, 2002 (DE) ..... 102 51 841

(51) Int. Cl.
*H01F 7/06* (2006.01)

(52) U.S. Cl. ..... 29/602.1; 336/192

(58) Field of Classification Search ..... 336/65, 336/90–96, 192, 198; 123/634–635; 29/602.1
See application file for complete search history.

(56) References Cited

U.S. PATENT DOCUMENTS

| | | | | |
|---|---|---|---|---|
| 3,533,054 | A | 10/1970 | Mancini et al. | |
| 4,721,935 | A | 1/1988 | Gunnels et al. | |
| 4,918,419 | A | 4/1990 | Ida | |
| 6,094,121 | A * | 7/2000 | Sakamaki et al. | 336/96 |
| 6,724,289 | B2 * | 4/2004 | Moga et al. | 336/90 |
| 6,747,540 | B1 * | 6/2004 | Nakase et al. | 336/192 |
| 7,075,400 | B2 * | 7/2006 | Lerchenmueller et al. | 336/192 |

* cited by examiner

*Primary Examiner*—Tuyen T. Nguyen
(74) *Attorney, Agent, or Firm*—Kenyon & Kenyon LLP

(57) ABSTRACT

An electrical connection set-up for manufacturing an ignition coil is provided, which includes, on the side of the low-voltage outlet, a contact spring which is installed by being lifted over corresponding secondary windings without touching them and which then snaps into place due to spring-like form or support, while elements provided on the contact spring break through an insulating layer surrounding the secondary winding, thus establishing the electrical connection without the use of thermal methods.

4 Claims, 4 Drawing Sheets

ELECTRICAL CONTACT BETWEEN THIN VARNISHED WIRES OF THE SECONDARY WINDING OF AN IGNITION COIL

FIELD OF THE INVENTION

The present invention relates to an electrical connection set-up for manufacturing an ignition coil, particularly a rod-type ignition coil having an ignition coil rod with a high-voltage outlet as well as a low-voltage outlet.

BACKGROUND INFORMATION

Ignition coils produce high-voltage sparks. This spark jumps between the electrodes of the spark plug set up at the ignition coil, thus igniting the air-gasoline mixture of an internal combustion engine, for example. Normally, this spark plug is supplied with high voltage from an ignition coil. A primary winding and a corresponding secondary winding are provided within the ignition coil. At one end, the primary winding is connected to an ignition switch, while its other end is connected to a so-called contact breaker.

The secondary winding, that is, the winding responsible for generating the ignition spark, is connected in the interior of the ignition coil to the one end of the primary winding, so that it is grounded. The other end of the secondary winding is connected to the high-voltage outlet, which in turn is either connected to an ignition cable leading to the spark plug, or at which outlet the spark plug is set up directly.

The secondary winding itself is made of a thin wire coated with a suitable layer of enamel so as to avoid the contacting of the individual wires when wrapping a specific support part or coil shell. Once the secondary windings have been wound onto a shell, the ends of the respective wires are contacted. Normally, thermal contacting methods such as soldering or welding, for example, are used for this purpose.

Different work processes are required especially with regard to contacting the primary and secondary windings in accordance with conventional methods. This entails higher installation costs, multiple assembly steps and also a certain number of connecting parts necessary to make an appropriate electrical connection.

Furthermore, in such a tight installation space, it is often difficult to bring about an appropriate contacting using the known thermal methods.

An object of the present invention is to provide a connection set-up between an ignition coil rod of an ignition coil and a secondary or primary winding which is inexpensive and readily implemented.

SUMMARY

In accordance with the present invention, additional contacting elements that break through the insulation of the enamel-coated wire of the secondary winding during installation are provided, thus bringing about an appropriate contacting.

In particular, it may be seen as an advantage for the electrical connection set-up for producing an ignition coil that the contacting according to the present invention is integrated into already existing components and may be reliably produced using simple processes.

Compared to the conventional method, the "cold" contacting method proposed here has the advantage that it involves no additional installation costs. In addition, the set-up of the present invention makes it possible to reduce the number of assembly steps and the number of connecting parts.

A further substantial advantage of the present invention is that the implementation of the contacting does not require optimization of the installation space. This means that it is not necessary to reserve a free space in the area of contacting, e.g., for electrode holders, soldering irons or the like.

According to the present invention, on the side of the low-voltage outlet, a contact spring is inserted via guide means, the contact spring gliding over a nose-like element when being inserted, so that the contact spring may be guided over the secondary winding without initially touching it.

Upon reaching a defined position provided by an opening or recess on the side of the contact spring, the nose-like element snaps into this opening, so that the contact spring rests on the secondary winding.

On the side of the contact spring facing the coil shell, contact elements are provided which press on the insulated wires of the coil shell during the snapping process and which, due to this snapping process, break the insulation at the corresponding contact points, so that an electrical contact can be established between the individual wires of the coil shell and the contact spring.

DETAILED DESCRIPTION

Figure 1:
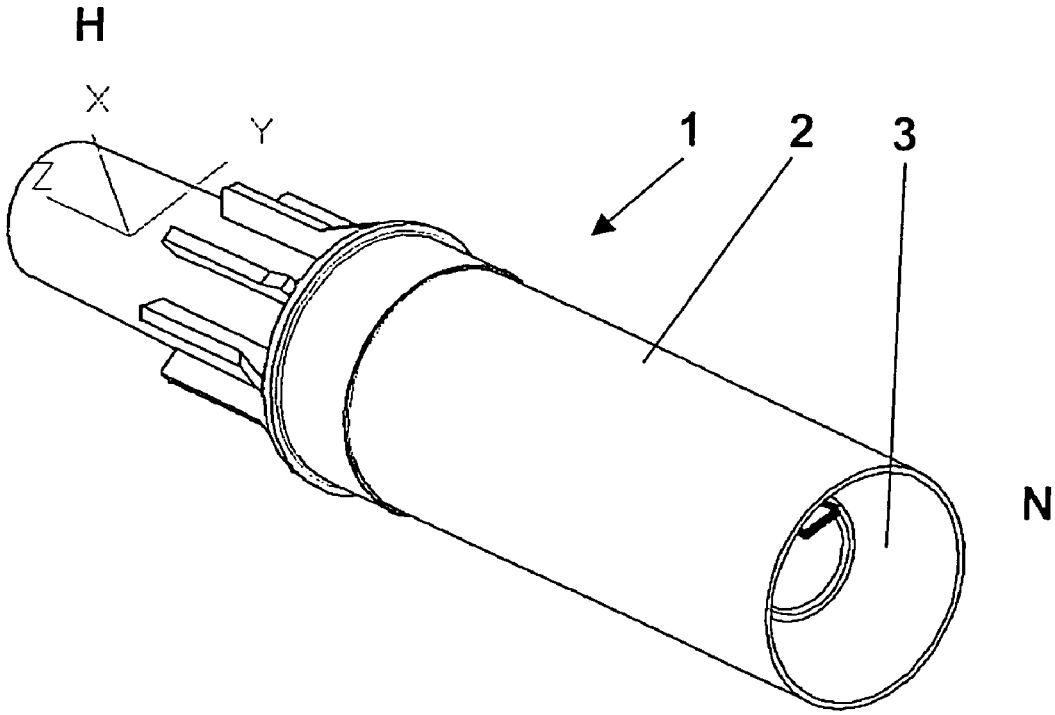
FIG. 1 shows a perspective view of an ignition coil having one side for the high-voltage outlet and another side for the low-voltage outlet.

FIG. 1 shows a perspective view of an ignition coil 1. Ignition coil 1 includes an ignition coil housing 2 and an ignition coil rod 3 located in ignition coil housing 2. In addition, ignition coil 1 features a side for a high-voltage outlet H and a side for the low-voltage outlet N. The side of low-voltage outlet N is provided to establish contact with a power supply not detailed in the drawing, while the side of high-voltage outlet H is provided for connecting to an ignition cable or a spark plug not detailed in the drawing.

Figure 2:
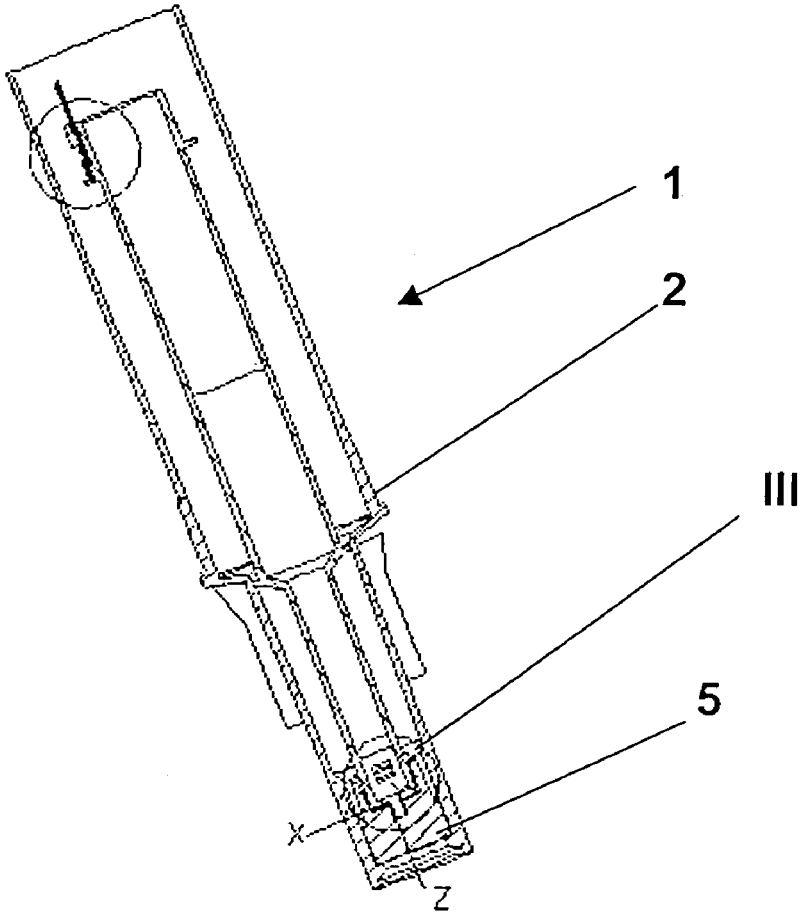
FIG. 2 shows a sectional view through the ignition coil according to FIG. 1.

FIG. 2 shows a sectional view of ignition coil 1 represented in FIG. 1, the areas shown relating to features of the present invention represented in more detail in the subsequent figures.

Figure 3:
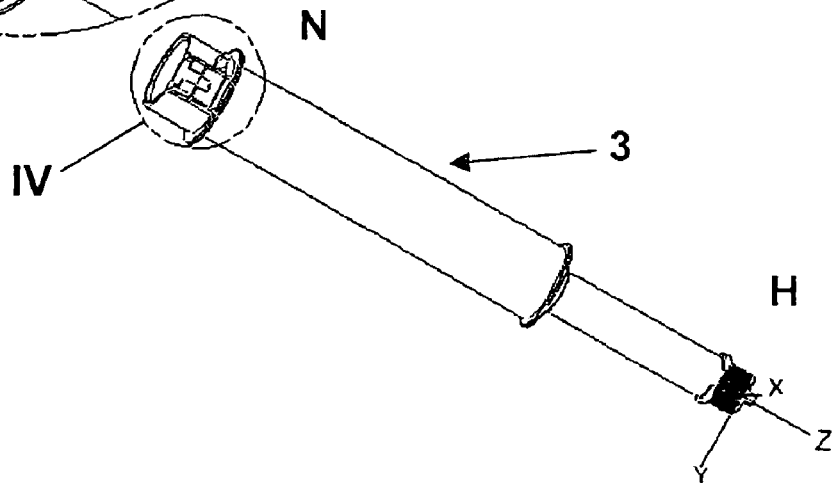
FIG. 3 shows a perspective view of an ignition coil rod located in the ignition coil housing shown in FIG. 1.
Figure 6:
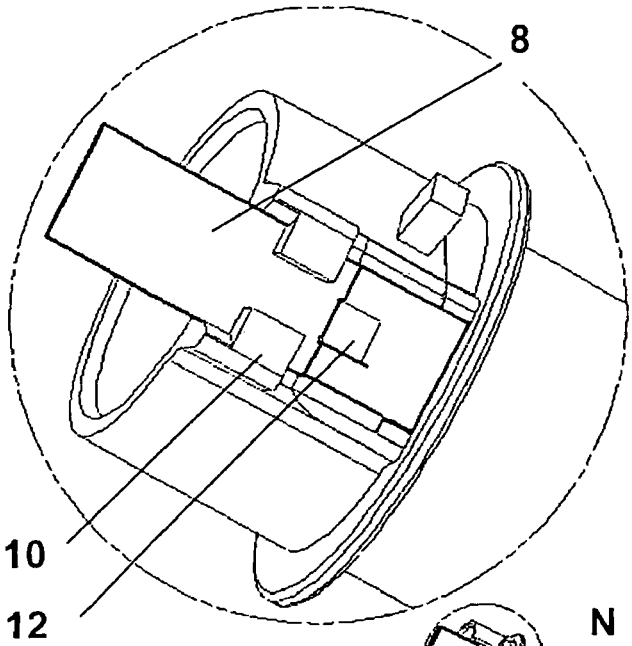
FIG. 6 shows a perspective view of an enlarged representation of the side of the low-voltage outlet of the ignition coil rod featuring a contact spring in a position prior to installation.
Figure 5:
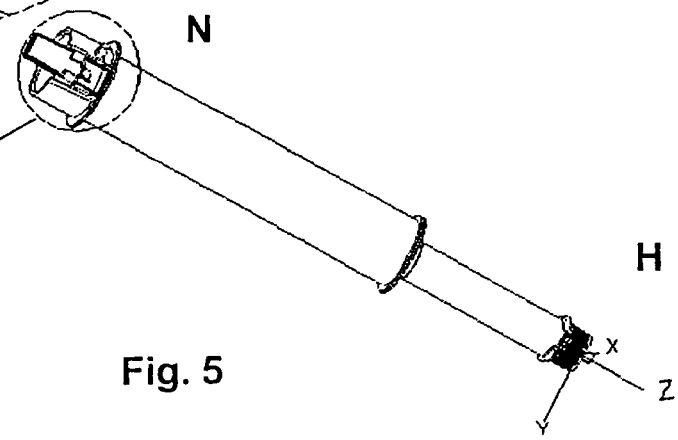
FIG. 5 shows a perspective view of the ignition coil rod, on the side of the low-voltage outlet featuring a contact spring.
Figure 7:
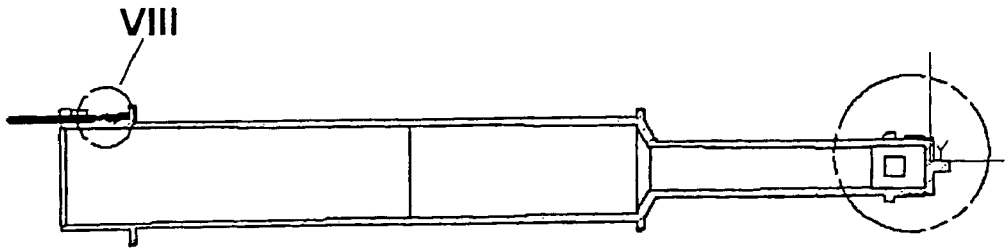
FIG. 7 shows a cross section through the ignition coil rod according to FIG. 5.
Figure 8:
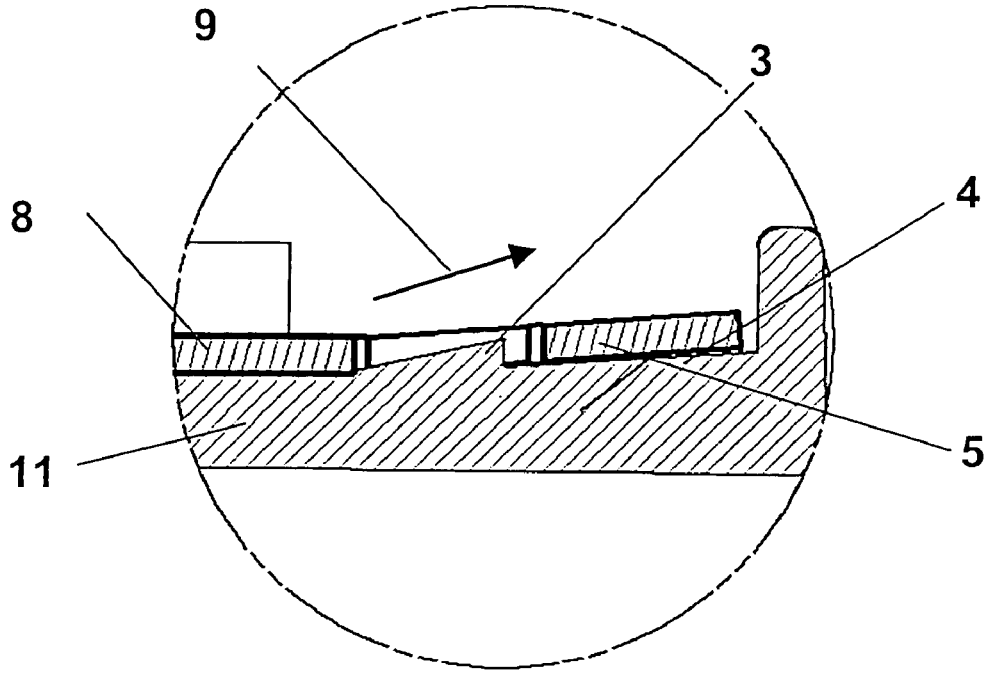
FIG. 8 shows an enlarged representation of the sectional view according to FIG. 7.
Figure 9:
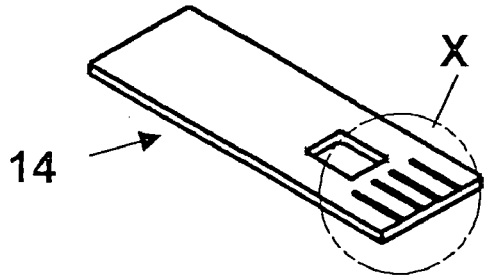
FIG. 9 shows a perspective view of the contact spring according to the present invention for installation on the side of the low-voltage outlet.

FIG. 3 shows ignition coil rod 3 having one side for high-voltage outlet H and one side for low-voltage-outlet N, which, immediately following its assembly, is insertable as a unit into ignition coil housing 2 represented in FIG. 1 and FIG. 2.

Figure 4:
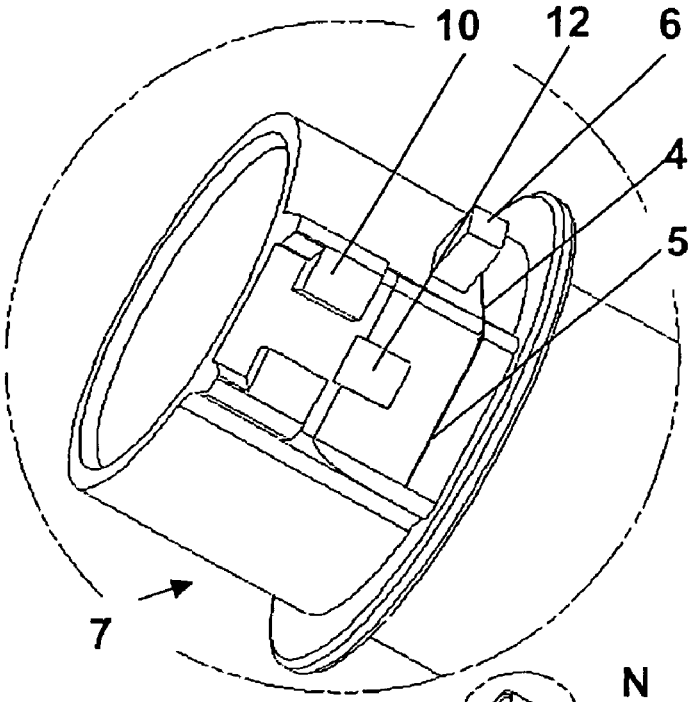
FIG. 4 shows a perspective view of the side of the low-voltage outlet of an ignition coil.

FIG. 4 shows an enlarged representation of the side of low-voltage outlet N of an ignition coil 1. A wire is wound onto a coil shell 4, resulting in secondary winding 5 provided here. One end of the wire of secondary winding 5 is attached to a so-called tie-up post 6, from which the wire is wound on the peripheral surface of coil shell 4 and extends over a defined contact area. This contact area at the same time serves as contacting area 7 for a contact spring 8, shown in FIG. 5 through FIG. 9, for establishing an electrical contact between secondary winding 5 and contact spring 8 itself.

Figure 10:
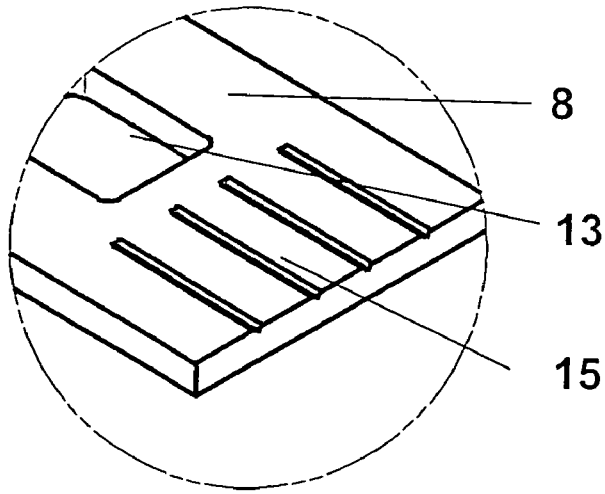
FIG. 10 shows an enlarged representation of the contact spring according to FIG. 9.

Once secondary winding 5 has been produced on coil shell 4, secondary winding 5 covers contacting surface 7 completely. Subsequently, contact spring 8 is slid via guide means 10 in the direction of arrow 9 according to FIG. 8. In this context, contact spring 8 glides on a surface 11 of ignition coil rod 3 until reaching a nose-like element 12 (see FIGS. 4 and 6). Contact spring 8 continues to glide on this nose-like element 12, so that it is guided at a distance to coil shell 4 shown in FIG. 8, i.e. at a distance to secondary winding 5. Once contact spring 8 reaches a defined position, nose-like element 12 penetrates an opening 13 of contact spring 8 shown in FIG. 9 and 10, so that the bottom side 14 of contact spring 8 rests completely against secondary winding 5. Contact elements 15, which are likewise located on bottom side 14 of contact spring 8, break through the insulating layer of secondary winding 5 and ensure that an electrical contact is established between contact spring 8 and secondary winding 5. Thus, an electrical connection is established without use of a thermal method.

What is claimed is:

1. A method for providing an electrical connection among components of a rod-type ignition coil unit including an ignition coil rod having a high-voltage outlet and a low-voltage outlet, comprising:

providing a secondary winding on a coil shell portion provided on a side of the low-voltage outlet; and providing on the side of the low-voltage outlet a contact spring, wherein the contact spring is slid over a contacting area of the coil shell provided with the secondary winding, and wherein the contact spring only contacts the secondary winding in a fixed end position.

2. The method as recited in claim 1, wherein the contact spring is slid over a protruding element situated on the side of the low-voltage outlet of the ignition coil rod until the protruding element engages an opening formed in the contact spring, whereby the protruding element and the contact spring lock into each other.

3. The method as recited in claim 1, wherein the contact spring has, on the side facing the contacting area of the coil shell, contacting elements that break through an insulating layer surrounding the secondary winding and contact the secondary winding.

4. The method as recited in claim 2, wherein the contact spring has, on a side facing the contacting area of the coil shell, contacting elements that break through an insulating layer surrounding the secondary winding and contact the secondary winding.

* * * * *